US006528131B1

(12) United States Patent
Lafond

(10) Patent No.: US 6,528,131 B1
(45) Date of Patent: Mar. 4, 2003

(54) INSULATED ASSEMBLY INCORPORATING A THERMOPLASTIC BARRIER MEMBER

(76) Inventor: Luc Lafond, 23 Woodvalley Cres., Etobicoke, Ontario (CA), M9A 4H4

( * ) Notice: Subject to any disclaimer, the term of this patent is extended or adjusted under 35 U.S.C. 154(b) by 0 days.

(21) Appl. No.: 09/553,320

(22) Filed: Apr. 20, 2000

Related U.S. Application Data

(63) Continuation-in-part of application No. 09/105,261, filed on Jun. 26, 1998, now abandoned, which is a division of application No. 08/513,180, filed on Aug. 9, 1995, now Pat. No. 5,773,135, which is a continuation-in-part of application No. 08/477,950, filed on Jun. 7, 1995, now Pat. No. 5,616,415, which is a continuation-in-part of application No. 07/871,016, filed on Apr. 20, 1992, now Pat. No. 5,441,779.

(30) Foreign Application Priority Data

Apr. 22, 1991 (CA) ..... 2040636

(51) Int. Cl.[7] ..... E06B 3/24
(52) U.S. Cl. ..... 428/34; 52/786.1; 52/786.13
(58) Field of Search ..... 428/34, 172, 192; 52/172, 786.13, 786.1

(56) References Cited

U.S. PATENT DOCUMENTS

| | | | | | |
|---|---|---|---|---|---|
| 2,253,219 | A | * | 8/1941 | Alexander | 428/167 |
| 3,027,608 | A | | 4/1962 | Ryan | |
| 3,544,294 | A | | 12/1970 | Goto | |
| 3,578,543 | A | * | 5/1971 | Cook et al. | 428/167 |
| 3,607,596 | A | * | 9/1971 | Fairbanks | 428/166 |
| 3,791,910 | A | | 2/1974 | Bowser | |
| 3,823,524 | A | | 7/1974 | Weinstein | |
| 4,113,905 | A | | 9/1978 | Kessler | |
| 4,268,553 | A | | 5/1981 | Marzouki et al. | |
| 4,335,166 | A | | 6/1982 | Lizardo et al. | |
| 4,348,435 | A | | 9/1982 | Mistrick et al. | |
| 4,393,105 | A | | 7/1983 | Kreisman | |
| 4,431,691 | A | * | 2/1984 | Greenlee | 428/34 |
| 4,576,841 | A | | 3/1986 | Lingemann | |
| 4,658,553 | A | | 4/1987 | Shinagawa | |
| 4,822,649 | A | | 4/1989 | Canaud et al. | |
| 4,831,799 | A | | 5/1989 | Glover et al. | |
| 4,950,344 | A | | 8/1990 | Glover et al. | |
| 5,007,217 | A | | 4/1991 | Glover et al. | |
| 5,048,997 | A | | 9/1991 | Peterson | |
| 5,106,663 | A | | 4/1992 | Box | |
| 5,120,584 | A | | 6/1992 | Ohlenforst et al. | |
| 5,128,181 | A | | 7/1992 | Kunert | |
| 5,196,254 | A | * | 3/1993 | Akiyama | 428/178 |
| 5,234,730 | A | * | 8/1993 | Lautenschlaeger et al. | 428/34 |

* cited by examiner

*Primary Examiner*—Donald J. Loney
(74) *Attorney, Agent, or Firm*—McFadden, Fincham

(57) ABSTRACT

An insulating spacer for use in glazing assemblies comprises a linear array of insulating chambers of linked cylindrical or semi-cylindrical shape. The spacer core may be formed from a semi-rigid material such as hollow blow moulded PVC or vinyl. A vapour barrier and desiccant matrix may be bonded to the interior face of the spacer core. As well, sealant material may cover at least partly the substrate engaging surfaces and/or the outside face of the spacer, to form a composite insulating spacer. The resulting spacer is energy efficient and relatively easy to manufacture and apply. An insulating glass assembly which incorporates such a spacer, is also provided.

17 Claims, 3 Drawing Sheets

INSULATED ASSEMBLY INCORPORATING A THERMOPLASTIC BARRIER MEMBER

This application is a continuation-in-part of U.S. application Ser. No. 09/105,261, Jun. 26, 1998 abandoned, which is a divisional application of U.S. application Ser. No. 08/513,180 now U.S. Pat. No. 05/773,135, filed Aug. 9, 1995, which, in turn is a continuation-in-part application Ser. No. 08/477,950 now U.S. Pat. No. 05/616,415, filed Jun. 7, 1995, and issued on Apr. 1, 1997, which, in turn, is a continuation-in-part application of U.S. application Ser. No. 07/871,016 now U.S. Pat. No. 05/441,779, filed Apr. 20, 1992 and issued on Aug. 15, 1995.

FIELD OF THE INVENTION

This invention relates to insulated glass assemblies. In particular, it relates to a composite spacer for use in an insulated glass assembly and further relates to an insulated glass assembly incorporating such a spacer.

BACKGROUND OF THE INVENTION

Insulated glass assemblies presently known in the art incorporate the use of various polymeric substances in combination with other materials. One such assembly includes a butylated polymer in which there is embedded an undulating metal spacer. Although useful, this type of sealant strip is limited in that the metal spacer, over time, becomes exposed to the substrates which results in a drastic depreciation in the efficiency of the strip. The particular difficulty arises with moisture vapour transmission when the spacer becomes exposed and contacts the substrates.

Further, many of the butylated polymers currently used in insulated glass assemblies are impregnated with a desiccant.

This results in a further problem, namely decreased adhesiveness of the butylated sealant.

Glover, et al. in U.S. Pat. No. 4,950,344, provide a spacer assembly including a foam body separated by a vapour barrier and further including a sealant means about the periphery of the assembly. Although this arrangement is particularly efficient from an energy point of view, one of the key limitations is that the assembly must be fabricated in a number of steps. Generally speaking, the sealant must be gunned about the periphery in a subsequent step to the initial placement of the spacer. This has ramifications during the manufacturing phase and is directly related to increased production costs and, therefore, increased costs in the assembly itself.

It has been found particularly advantageous to incorporate, as a major component of the spacer, a soft, resilient insulated body, having a low thermal conductivity. Examples of materials found to be useful include natural and synthetic elastomers (rubber), cork, EPDM, silicones, polyurethanes and foamed polysilicones, urethanes and other suitable foamed materials. Significant benefits arise from the choice of these materials since not only are they excellent insulators from an energy point of view but additionally, depending on the materials used, the entire spacer can maintain a certain degree of resiliency. This is important where windows, for example, engaged with such a strip experience fluctuating pressure forces as well as a thermal contraction and expansion. By making use of a resilient body, these stresses are alleviated and accordingly, the stress is not transferred to the substrates as would be the case, for example, in assemblies incorporating rigid spacers. However, an overly resilient spacer will tend to flex sideways, twist or compress either during the assembly process or subsequently when the insulated assembly is stressed.

Effective insulating spacers may achieve their effectiveness by trapping a volume of dead air. For example, the spacer body may comprise a thermal plastic or thermal setting foam material. However, conventional foam materials are typically relatively soft and may not be sufficiently rigid for use in association with insulating glass units. As well, a foam spacer formed essentially of a strip of foam material, having a rectangular cross-section, will tend to buckle at the spacer corners. Spacer buckling may be addressed either by rounding off the corners, which presents functional and aesthetic drawbacks, or by slitting and backfilling of the corners. The latter approach, while effective, requires a number of steps and may be relatively costly. Thus, there is a need for an insulating spacer material which has a degree of rigidity, readily forms sharp corners, and is relatively inexpensive and simple to fabricate and apply. Desirably, such a material traps a volume of dead air therein to achieve a superior level of insulation.

It would be desirable to have a composite spacer which overcomes the limitations of desiccated butyl as well as requiring the addition of sealant material in a subsequent procedure. The present invention is directed to satisfying the limitations in the known art.

The term "glass" herein also embraces plastics such as Plexiglass (tm) and the like.

SUMMARY OF THE INVENTION

An object of the present invention is to provide an improved spacer for use in insulated glass or glazing assemblies, the spacer incorporating a volume of dead air or other gas to achieve superior insulating qualities. A further object is to provide an improved insulated glass assembly incorporating such a spacer. A further object is to provide an improved spacer which is an effective insulator, while being relatively simple and inexpensive to manufacture and apply. A further object is to provide an insulating spacer which is relatively rigid and resists twisting and bending forces.

In accordance with the above objects, in one aspect the invention comprises a composite spacer for spacing substrates in an insulated glass assembly. The spacer comprises: an insulating spacer core having upper and lower flat substrate engaging surfaces, a front face for facing into the interior of said insulated glass assembly, and a rear face spaced apart from said front face. The spacer core comprises a generally linear array of cellular members. The rear face of the core is characterized by a regular array of deep indentations which define the individual members. In one version, the indentations are rounded to form a sinusoidal or undulating rear face. Alternatively, the members may be triangular or rectangular in cross-section. Preferably, the members each comprise a hollow, gas-filled chamber. In this version, the interior of said spacer core comprises an essentially linear array of hollow cells for trapping dead air therein, wherein said semi-cylindrical members each define a single cell. Conveniently, the spacer body is formed from blow moulded plastic such as PVC or vinyl.

In another aspect, both of the front and rear faces of the spacer core undulate to form an essentially linear array of generally cylindrical members, each of which defines a hollow cell or chamber.

In another aspect, a composite spacer is provided in which the rear face of the above spacer core is covered by a sealant material such as silicone or hot melt. In a further aspect, the substrate engaging surfaces of the spacer body are both covered with a sealant material such as a hot melt material. The front face preferably incorporates one or more of a vapour barrier film and a desiccant.

In another aspect, a composite spacer core comprises a pair of spacer cores in face to face relation, surrounded by hot melt or other flowable substrate to bind them together. For example, the spacer cover may each comprise an array of triangular members which interfinger when placed in face to face relationship.

In a further aspect, a clip is provided to hold neighboring spacer core cellular members in angled disposition to each other where the spacer extends around a corner.

The spacer core may be formed in a fully extruded fashion partly or fully surrounded by hot melt, Swizzle (TM) or other matrix. Alternatively, the spacer core may be co-extruded with one or more matrices such as desiccant, hot melt or other backing.

Preferably, the spacer core is formed from blow moulded PVC or vinyl, to form an essentially linear array of hollow cells or chambers, each cell having an outside sidewall being defined by an undulation of the spacer body.

The advantages achieved by a structure, include relatively high resistance to compressive forces as a result of the rigidity of the structure. As well, twisting and sideways bending of the spacer is minimized as a result of the spacer's relative rigidity. Preferably, the width of the spacer is sufficiently wide to minimize twisting and bending. As well, the undulations permit the spacer to form relatively sharp corners without slitting.

Suitable sealants include polyisobutylene (PIB) butyl or other butylated material which extends about the periphery of the assembly or at least on the flat substrate engaging surfaces of the spacer core and thereby provides a further sealed surface. Sealing or other adhesion for the insulating body may be achieved by providing special adhesives such as acrylic adhesive at the substrate engaging surfaces. Further, the material at the substrate engaging surfaces may be uncured so that on application of heat, the body adheres directly to the substrate. This is effective where there is provided at the substrate engaging surfaces a material composed of, for example, a ultra violet curable material.

The spacer may comprise a composite structure which includes as an integral component a desiccant matrix and/or vapour barrier film, on the front face of the spacer body. The desiccant material may be in the form of a matrix of a semi-permeable material. Various silicones with desiccant material disbursed therein are known to the art. Alternatively, where a separate matrix is not incorporated, a sealant material on the front face may include a desiccant material. Adhesive layers on the upper and lower faces permit the spacer to be mounted to substrates such as glass to form an IG unit.

In a further aspect, the invention comprises an insulating assembly, comprising spaced apart glass or plastic substrates, with a spacer of the type described above extending around the periphery of the assembly. A further layer of sealant material may be provided around the periphery of the assembly in contact with all or part of the rear face of the spacer.

DETAILED DESCRIPTION OF THE PREFERRED EMBODIMENTS

Figure 1:
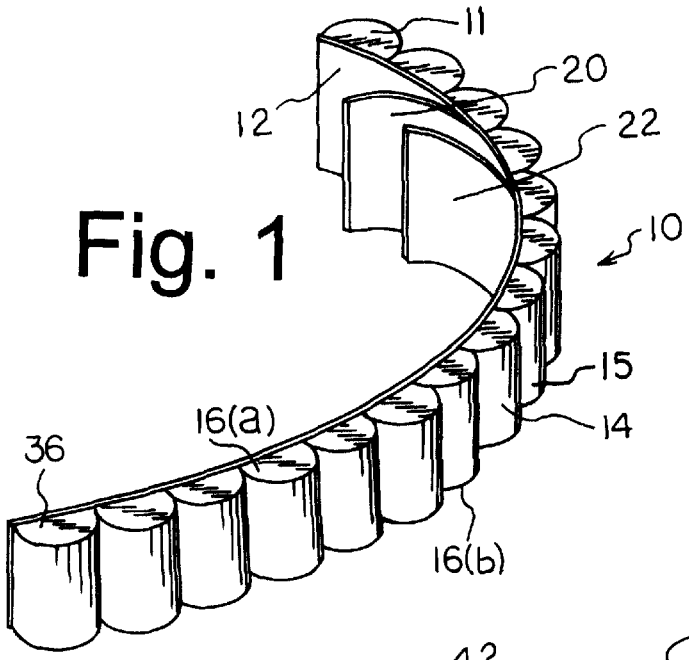
FIG. 1 is a perspective view of a composite spacer according to the present invention.

Referring to FIGS. 1, 3, 4 and 10, a first embodiment of a composite spacer 10 is illustrated. The spacer 10 comprises a spacer core 11, having a front face 12, which when the spacer is assembled within an insulating glass assembly, faces into the interior of the assembly, and a rear face 14 spaced apart from and opposed to the front face. The core 11 further includes upper and lower substrate engaging surfaces 16(*a*) and (*b*). In this version, the front face 12 of the spacer core is generally smooth, while the rear face 14 undulates or is sinusoidal in shape. The spacer body thus comprises a generally linear array of linked generally semicylindrical members 15. The top and bottom faces of the spacer comprise substrate engaging surfaces, and are substantially flat.

The spacer core is formed from blow moulded PVC or vinyl, with each of the cylindrical members being hollow. Thus, the spacer body comprises a linear array of generally hollow cells, the interior of each of which forms a dead air volume. Alternatively, the interiors may be filled with a gas having superior insulative qualities such as a noble gas. The individual cells or chambers which form the spacer body are preferably fully sealed from the external atmosphere.

The spacer core forms a component of a composite spacer. Bonded to the front face of the spacer core is a fluid barrier 20 to further prevent any exchange of gas or vapour with the interior of the insulated glass assembly. The fluid barrier may comprise a PET film which may further include an aluminum or other suitable metal layer. In addition, other metalized or non-metalized films may be used in this capacity.

The composite spacer may include a desiccant matrix 22 bonded to the fluid barrier at the front (interior) face of the spacer body. Suitable desiccant matrices are well known in the art and can include zeolite beads, silica gel, calcium chloride, etc., all of which may be matrixed within a semi-permeable flexible material such as a polysilicone or other suitable semi permeable substance. As a further option, the desiccant material may be incorporated into a continuing body of butyl material which covers at least partially the substrate engaging surfaces of the spacer body.

Figure 3:
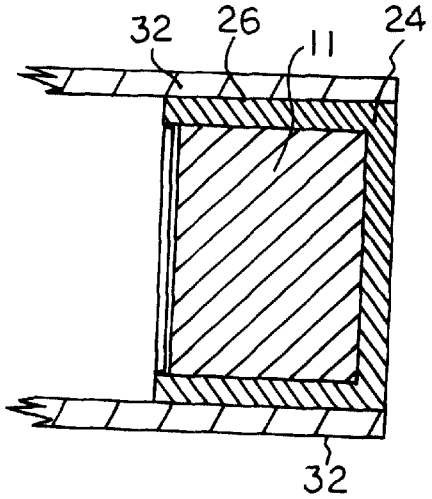
FIG. 3 is a sectional view of a portion of a glazing assembly illustrating the disposition of a spacer therein.
Figure 10:
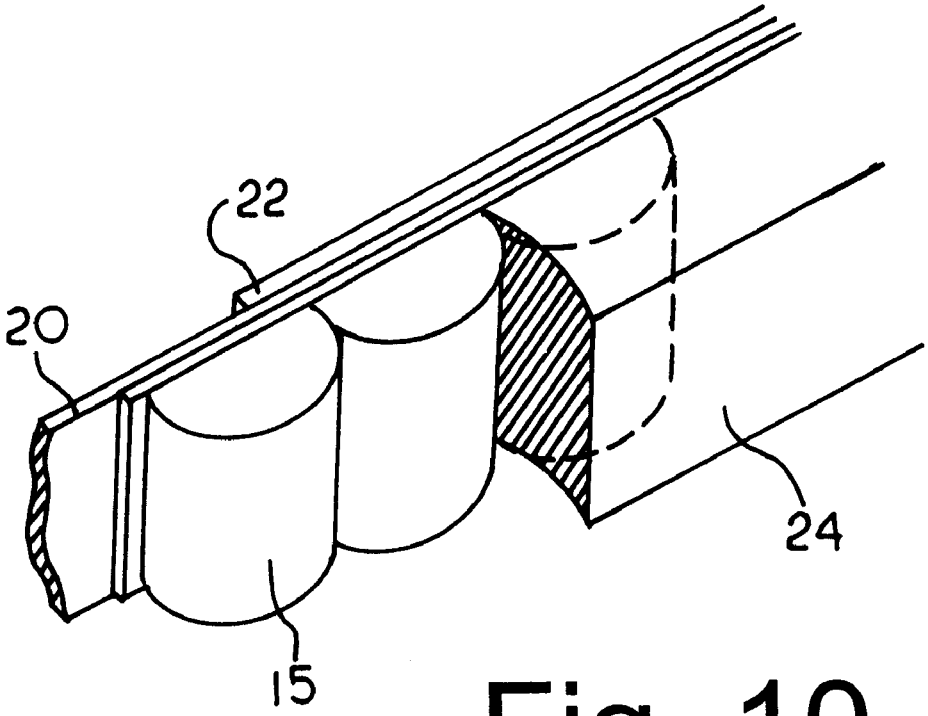
FIG. 10 is a perspective view, illustrating a composite spacer featuring a spacer core as shown in FIG. 1.

As seen in FIGS. 3 and 10, the spacer core 11 is at least partially encapsulated within a sealant material 24 which partially or fully covers the substrate engaging surfaces of the spacer core. The sealant may comprise hot melt or PIB, which is either co-extruded with the spacer core or alternatively may be applied in a secondary operation. The various components of the composite spacer may be of a uniform colour, or any combination of colours.

The substrate engaging surfaces 16(*a*) and (*b*) of the spacer 10 may also be partly or fully covered by an adhesive 26 to assist in the sealing and adhering engagement of a substrate with a respective side of the spacer core. The sealant and/or adhesive may comprise an uncured material capable of bonding with the substrates upon exposure to heat, ultraviolet radiation, or other curing agent.

Figure 4:
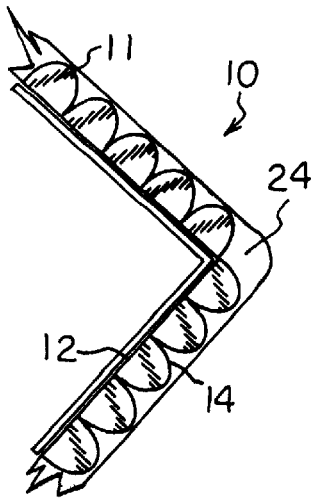
FIG. 4 illustrates the spacer of FIG. 1, in a flexed position to extend sharply around the corner of an insulated glass window assembly.

As further illustrated in FIG. 3, an insulated glass assembly 30 incorporating the spacer 10 defined above, includes substrates 32 bonded to either side of the spacer body, with the desiccated matrix 22 and vapour barrier film 20 facing the interior of the assembly. A sealant such as silicone 24 may cover the outside (rear) face 14 of the spacer body. An insulated assembly thus formed, in a particular one having the interior volume filled with an insulating gas such as argon or other noble gas, forms a highly effective insulator. The cellular arrangement of the spacer body, wherein the spacer core is formed from an array of chambers each trapping a volume of dead air or other gas, is highly effective as an insulator. It is contemplated that the assembly process of such an assembly is relatively simple, whereby the spacer material is simply bent around each corner during assembly of the various components, as seen in FIG. 4.

Figure 2:
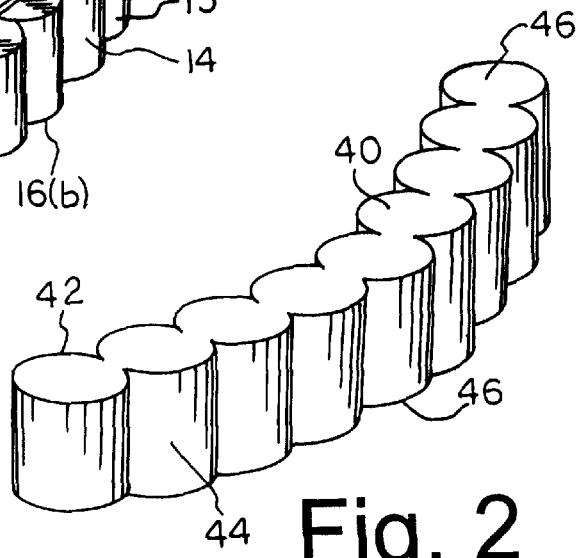
FIG. 2 is a perspective view of an alternate embodiment of the spacer core illustrated at FIG. 1.

In a further version of the spacer core, shown at FIG. 2, the spacer core 40 forms an essentially linear array of chambers, with both of the front and rear faces 42 and 44 of the core being undulating or sinusoidal in profile. In this version, the spacer core 40 forms a generally linear array of linked generally cylindrical members, each of which comprises a hollow chamber. The entire spacer core 40 is formed from hollow blow moulded PVC or vinyl as in the above version. The spacer core may be partly or fully encapsulated with sealant (not shown), with optionally an adhesive material on the flat upper and lower substrate engaging surfaces 46.

Figure 5:
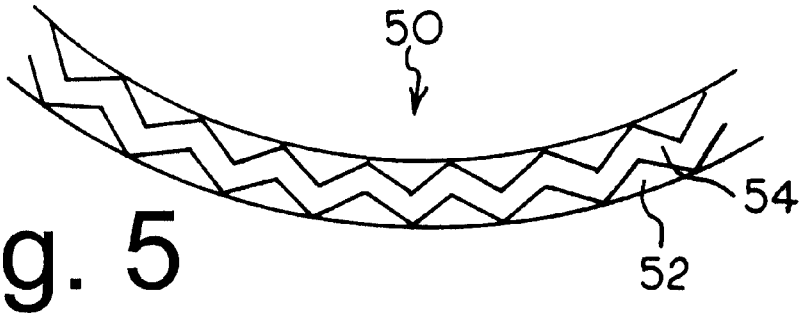
FIG. 5 is a sectional schematic view of a further embodiment of the invention, illustrating a spacer extending around a radius.
Figure 6:
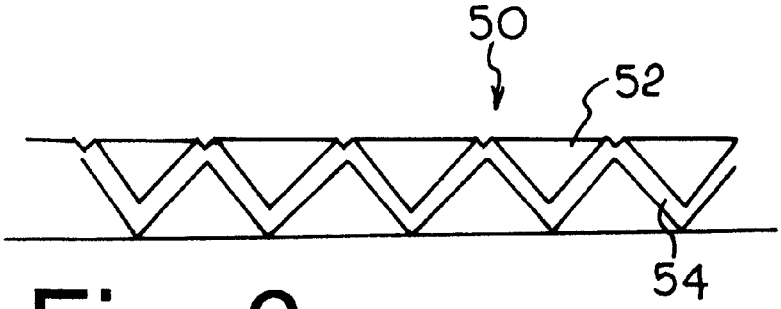
FIG. 6 is a schematic sectional view of the embodiment shown in FIG. 5.

A third version of the spacer core is shown at FIGS. 5 and 6 and comprises a composite spacer core. The composite spacer core 50 of this version comprises paired linear arrays of hollow cellular members 52, which are arranged in face to face staggered relationship. The opposing arrays are spaced apart to form an intersticial space between the arrays which may be filled by a matrix such as hot melt or PIB. The flat bases of the triangular members face the outside faces of the composite spacer core 50, thereby forming a spacer core which may be bent around corners while maintaining a smooth exterior appearance.

Figure 7:
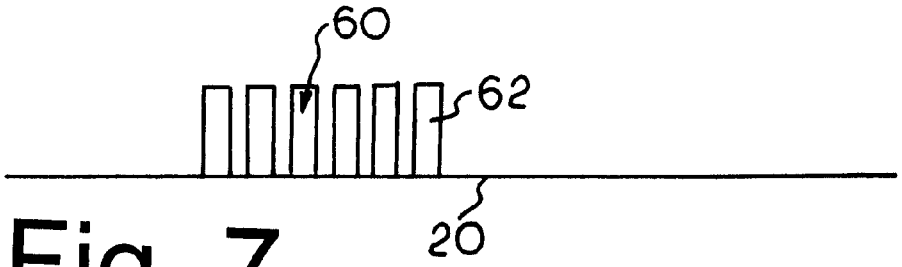
FIG. 7 is a schematic sectional view of a further embodiment of the spacer core according to the present invention.
Figure 8:
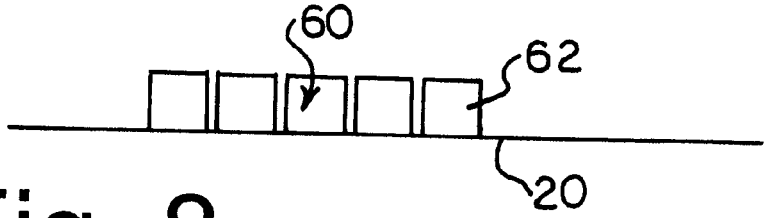
FIG. 8 is a schematic sectional view of a further embodiment of the spacer core.
Figure 9:
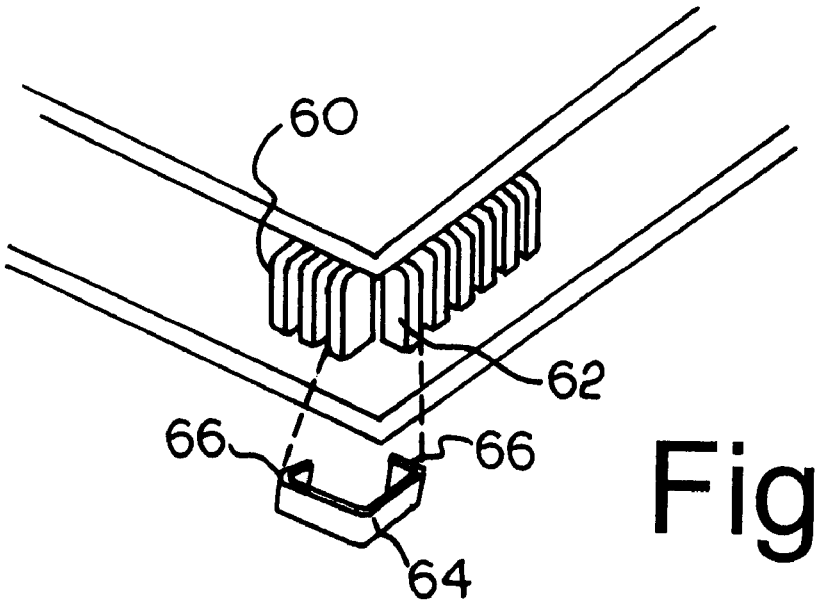
FIG. 9 is a perspective view of a spacer core, illustrating a spacer corner clip according to the present invention.

FIGS. 7 and 8 illustrate a further embodiment of a spacer core 60. In this version, the cellular members are generally rectangular in section, and spaced apart. The intersticial spaces between the members is conveniently filled with a matrix such as hot melt or PIB. The individual members are mounted to a support matrix such as a vapour barrier film 20 to hold the spacer core together. The individual core members 62 comprise hollow cellular members as characterized above. As shown in FIG. 9, when this spacer core arrangement extends around a sharp corner, the cellular members 62 at the corner are spread apart by approximately 90 degrees. The invention further contemplates a spacer clip 64, which joins neighboring spacer core members at the point where the spacer extends around a corner. The clip includes gripper members 66 shaped to slide into the intersticial spaces between spacer core members, and retain neighboring core members together to prevent excess separation of neighboring members.

The insulated glass assembly shown herein comprises a double pane assembly. However, it will be appreciated that the same or similar arrangement may form a multi-pane assembly.

What is claimed is:

1. An insulating glass assembly, comprising:

first and second glass substrates, and an insulating spacer having spaced apart upper and lower substrate engaging surfaces engaging a respective surface of said first and second substrates, a front face facing the interior of said assembly and a rear face opposed to and spaced from said front face said spacer having a core comprising a body having an undulating wall defining an array of individual hollow chambers, said hollow chambers enclosing a volume of air and extending in a direction between said first and second glass substrates.

2. An insulated glass assembly as defined in claim 1, wherein said hollow chambers are air chambers, said spacer having top and bottom walls to thereby form enclosed air chambers and provide said upper and lower substrate engaging surfaces.

3. An insulated glass assembly as defined in claim 1, wherein both of said front and rear faces are comprised of an undulating wall.

4. An insulated glass assembly as defined in claim 1, wherein said rear face has a generally sinusoidal or wave shaped profile.

5. An insulated glass assembly as defined in claim 1, wherein each of said chambers is a hollow gas-filled chamber.

6. An insulated glass assembly as defined in claim 1, wherein said spacer is formed from blow moulded PVC or vinyl.

7. An insulated glass assembly as defined in claim 1, wherein said spacer core is at least partially encapsulated within a sealant material.

8. An insulated glass assembly as defined in claim 1, wherein said front face of said spacer core is generally smooth within a fluid barrier means at said front face.

9. An Insulated glass assembly as defined in claim 8, where there is bonded to said fluid barrier means a desiccant containing matrix.

10. An insulated glass assembly as defined in claim 1, wherein said substrate engaging surfaces are at least partly covered by an adhesive.

11. An insulated glass assembly as defined in claim 1, wherein both of said front and rear faces have an undulating profile to form an essentially linear array of linked chambers.

12. An insulated glass assembly as defined in claim 11, wherein both of said front and rear faces have an wave shaped or generally sinusoidal profile to form an essentially linear array of linked chambers.

13. An insulated glass assembly as defined in claim 12, wherein each of said chambers is gas-filled.

14. An insulated glass assembly as defined in claim 13, wherein each of said chambers is generally triangular in cross-section.

15. An insulated glass assembly as defined in claim 14, further comprising a second spacer core, arrange in an offset relationship thereto to form a composite spacer core, the apices of said triangular members facing into the interior of said composite spacer core and the fiat bases facing the exterior thereof, said spacer core being spaced apart to form ain intersticial space therebetween, said intersticial space being filled with a matrix.

16. An insulated glass assembly as defined in claim 14, wherein said chambers are generally rectangular in cross-section and spaced apart from each other, said members being joined together by a support matrix forming said front face of said spacer core.

17. An insulated glass assembly as defined in claim 15, comprising a clip member for engaging adjacent or near-adjacent spacer core chambers to restrict separation thereof at a corner, said clip member comprising a generally L-shaped member having engagement means to engage with corresponding spacer core chambers.

* * * * *